US005653605A

United States Patent [19]

Woehl et al.

[11] Patent Number: 5,653,605

[45] Date of Patent: Aug. 5, 1997

[54] LOCKING COUPLING

[76] Inventors: Roger Woehl, 73 Arlen Dr., Rohnert Park, Calif. 94928; Edward P. Goett, 1700 Foxridge Rd., Geyserville, Calif. 95441

[21] Appl. No.: 543,554

[22] Filed: Oct. 16, 1995

[51] Int. Cl.[6] ..... H01R 4/38

[52] U.S. Cl. ..... 439/321

[58] Field of Search ..... 439/307, 310, 439/311, 318, 320–323, 352, 350

[56] References Cited

U.S. PATENT DOCUMENTS

| | | | |
|---|---|---|---|
| 3,203,739 | 8/1965 | Young . | |
| 3,465,092 | 9/1969 | Schwartz . | |
| 3,603,913 | 9/1971 | Hasty, Jr. . | |
| 3,732,527 | 5/1973 | McKnight . | |
| 4,074,927 | 2/1978 | Ball | 439/321 X |
| 4,239,314 | 12/1980 | Anderson et al. | 439/321 |
| 4,902,238 | 2/1990 | Iacobucci . | |
| 5,082,454 | 1/1992 | Tonkiss et al. | 439/320 |
| 5,192,219 | 3/1993 | Fowler et al. . | |
| 5,211,576 | 5/1993 | Tonkiss et al. . | |
| 5,366,383 | 11/1994 | Dearman . | |
| 5,496,189 | 3/1996 | Over et al. | 439/321 |

*Primary Examiner*—Khiem Nguyen

[57] ABSTRACT

A locking coupling primarily for backshell connectors includes basically a main cylindrical body through which wires pass to an electrical connector, a coupling collar for connecting the backshell to the connector and a locking collar in one position permitting the coupling collar to rotate relative to the main body and in a second position locking this coupling collar to the main body, the main body having a circumferential ring of radial and axially extending teeth, a pawl having teeth carried by the coupling collar in alignment with the teeth of the main body, the locking collar forcing the teeth of this pawl into tight engagement with the teeth of the main body in the locking position.

10 Claims, 7 Drawing Sheets

114
115
116

104
122
123
110
108
138
114
120
124
106
118
102

12
18
34
30
26
33
31
40
35
32
4
8
6

LOCKING COUPLING

FIELD OF THE INVENTION

The present invention relates to rotatable spin couplings, and more particularly to a mechanical locking means for rotatable spin couplings to prevent de-coupling resulting from shock and vibration.

BACKGROUND OF THE INVENTION

The loosening of threaded spin couplings as a result of shock and vibration has long been recognized as a common cause of failure in adapters for electrical cabling and conduits. The historical methods used to solve this problem fall into two general categories, retention methods and locking methods.

Retention methods utilize some means of increasing the torque required to remove the spin coupling. Examples include adhesive coatings applied to threads, and mechanical detent devices which use a racheting mechanism to resist rotation in the coupling. These retention methods have the advantage of being easy to install, however, none provide a positive lock which will prevent coupling rotation. Both of these type of devices are subject to loosening in extreme operating conditions.

Locking methods utilize some means of preventing the spin coupling from rotating around an adapter body. The most common example of a locking method is the use of lock wires wherein a piece of wire is secured to the coupling and a fixed object thus preventing rotation. Lock wire provides a positive lock that prevents the coupling from loosening until the lock wire is removed. While effective in locking the coupling, the wire is cumbersome to install and repair.

Inventors have created several types of coupling locking devices that are integral with the coupling. U.S. Pat. No. 5,192,219 to Fowler et al. (1993) discloses a locking device that utilizes spring fingers to prevent rotation of the coupling; however, these spring fingers are expensive to manufacture, and result in a longer than normal coupling. The locking couple of U.S. Pat. No. 5,366,383 to Dearman (1994) is also much longer than a normal coupling.

A locking coupling must have a latching device that ensures that the lock remains locked, and is impervious to shock and vibration. The force required to engage and disengage the latch is critical to its performance under shock and vibration. Both of the above integral locking devices use an axial motion to engage and disengage the lock which limits the latching force to that of the finger strength of the installer, without having to use special tools. This factor is a clear disadvantage over a rotational locking motion which allows the installation tool to be used as a latching tool as well.

Current locking mechanisms can be damaged by improper removal by persons unfamiliar with the design. Repair facility personnel unfamiliar with the locking device can permanently damage the locking system by attempting to remove the coupling without first unlocking the coupling.

OBJECTS OF THE INVENTION

It is an object of the present invention to provide a locking coupling with a locking device that prevents rotation of the coupling relative to a body.

It is an object of the present invention to provide a locking coupling that can be removed without damage by a person having no prior knowledge of the function of the locking mechanism.

It is an object of the present invention to provide a locking coupling that will automatically unlock itself when a person attempts to unscrew the coupling from a body.

It is still another object of the present innovation to provide a locking coupling with a length equivalent to comparable non-locking couplings; specifically is shorter than prior art locking coupling.

It is still another object of the present invention to provide a locking coupling in which the force required to lock and unlock can be determined at the time of manufacture.

It is yet another object of the present invention to provide a locking coupling that can be locked and unlocked with the same standard tools used to install the coupling.

It is still another object of the present invention to provide a locking coupling that will remain locked under shock and vibration.

It is an object of the present invention to provide a locking coupling with a visual indicator to identify the locked and unlocked conditions.

It is still another object of the present invention to provide a locking coupling that allows for easy component assembly during manufacturing.

It is yet another object of the present invention to provide a locking coupling that will automatically lock when the desired coupling installation torque is reached.

It is another object of the present invention to provide a locking coupling that requires a compound motion (axial and rotational) to unlock the coupling, thus preventing vibration in any one direction from causing the coupling to unlock.

Another object of the present invention is to provide a relatively short locking coupling for multiple uses including use with backshell connectors.

BRIEF DESCRIPTION OF THE PRESENT INVENTION

The present invention comprises a hollow cylindrical body, having an outer circumferential ring of axially extending radial teeth, a first coaxial collar (a coupling collar) secured to said body, rotatable with respect thereto, and having a notch at one end in which is positioned a pawl having inwardly directed radial teeth overlying the ring of teeth of said cylindrical body. A second coaxial collar (a locking collar) is rotatably mounted on said coupling collar and overlies said toothed pawl; the locking collar internal configuration being such that in one position it permits the teeth on the pawl to freely float in and out of contact with the teeth on the body (providing a clicking sound). In another position the collar forces the teeth on the pawl into intimate contact with the teeth on the body whereby to resist rotation of the elements relative to one another.

The force resisting rotation and de-coupling may be determined by the number of teeth on the pawl and/or the number of pawls. A spring element, either integral with, or separate from the pawl cooperates with a profile on the locking collar to maintain a locked condition. The forces required to lock and unlock the device may be determined at the time of manufacture by the strength of the spring in conjunction with a locking collar profile. The present invention operates as a racheting detent in an unlocked position, and a positive anti-rotation lock in a locked position. The locking mechanism can be engaged by movement of the locking collar by either axial, radial, or preferably an axial and radial movement in combination.

The locking coupling may be designed so that the same tools that are used to install and tighten the coupling to a further body for instance, multicontact electrical connector, may be used to engage or disengage the lock, thus allowing for a greater retention force on the locking mechanism. The force require to lock and unlock the coupling can be set at the time of manufacture, and may be set sufficiently low as to allow for engagement by hand without the use of any tools.

The design concept accommodates several methods of installing and locking the coupling, all achieved with subtle changes to the locking ring, coupling, and pawl of the current invention.

In a first configuration the locking ring completely encapsulates the coupling, installation being achieved by axially moving and then rotating the locking ring, which when in the unlocked position transmits the rotation to the threaded coupling member. Locking is achieved by sliding the locking collar back, rotating it a predetermined number of degrees, and then allowing it to spring forward, unlocking is achieved with the same motions in the reverse rotational direction.

In a second configuration, both the locking collar and ring can have a hexagonal outer profile. In an unlocked position all of the flats on the hex are aligned allowing a wrench to be used to screw the coupling to a further body. When locked the flats are miss-aligned, preventing the use of a wrench until the coupling is unlocked.

In the second variation of the locking ring the means of transmitting rotation to the coupling can be configured such that when a predetermined torque is obtained, the locking ring overcomes a spring force and automatically slips into a locking position. Similarly the coupling can be unlocked by rotating the locking ring to first overcome a spring force to disengage the lock, and then proceed to unscrew the coupling.

Visual markings on the coupling may indicate its locked or unlocked condition.

DETAILED DESCRIPTION OF THE PRESENT INVENTION

Figure 1:
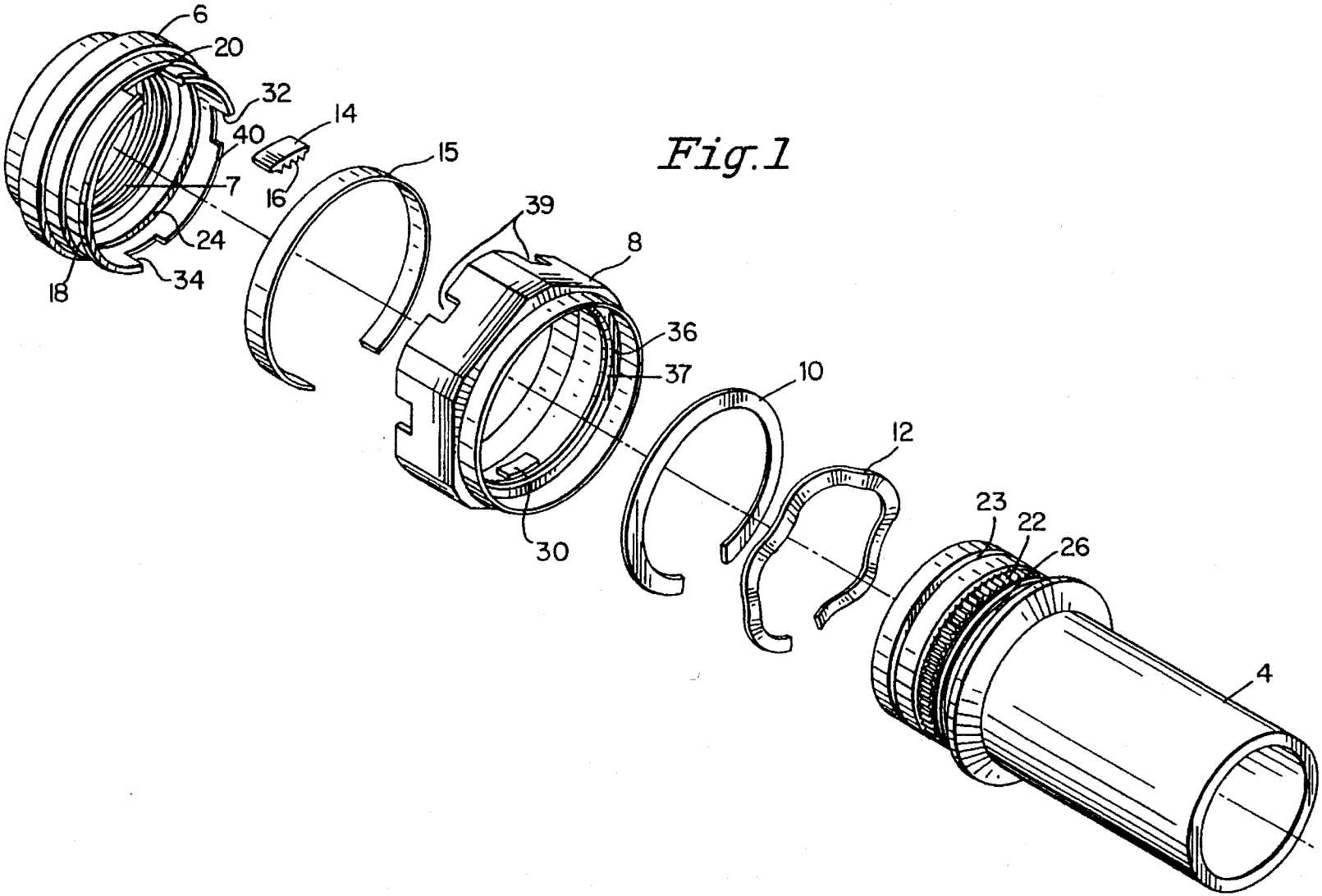
FIG. 1 is an exploded view of a disassembled coupling.

Referring specifically to FIG. 1 of the accompanying drawings, the adapter illustrated as a backshell adapter for purposes of illustration, comprises a hollow cylindrical body 4, a first collar 6, a locking collar 8, a retaining ring 10, a wave spring 12, a pawl 14 and a pawl spring 15.

The first collar 6 has an axially extending skirt 18 in which a cutout 20 is located; the cutout being sized to receive the pawl 14. The pawl 14 has a plurality of inwardly directed radial teeth 16 suitable for mating with a circumferential band of radially extending, axially aligned teeth 22 on the body 4. A pawl spring 15 is located interiorly of collar 6 and extends over the pawl 14 in the skirt 18, to provide a radially inwardly directed force on the pawl 14. The locking collar 8 has an internal configuration which cooperates with the external surface of the pawl 14 and pawl spring 15 to produce engagement and disengagement of the two sets of teeth 16 and 22, as more fully described relative to FIGS. 2 through 5.

Figure 4:
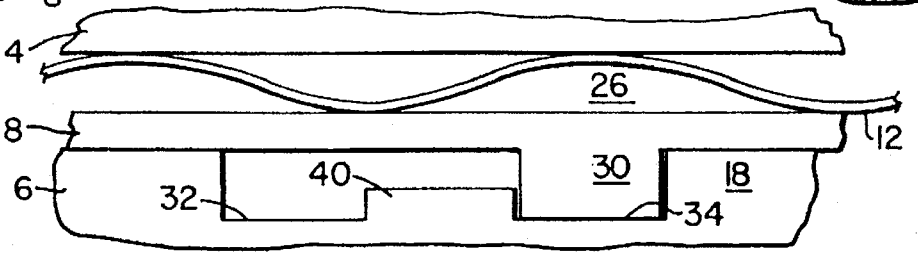
FIG. 4 is a partial view in the unlocked position of the first collar skirt and locking collar key shown as if unwrapped and laid on a flat surface to illustrate the coupling in the unlocked position.

A key 30 in lock collar 8 engages alternatively in cutouts 32 and 34 in the skirt 18 of first collar 6 such that in an unlocked position illustrated in FIG. 4, key 30 seats in cutout 32 so that a rotation in either direction of locking collar 8 causes a rotation of the first collar 6. Threads 7 of collar 6 may now be screwed onto a further body. In locked position key 30 engages in cutout 34 to hold the locking collar 8 in a locked position relative to body 4 until specific means are taken to unlock the coupler.

In the illustrated embodiment of the invention, the means of moving the locking collar 6 from a locked to an unlocked position and back again, requires first an axially rearward motion against wave spring 12 followed by a rotational motion. The direction of rotation required to lock the coupling is determined by the direction of rotation required to thread the first collar 6 onto a further threaded body. This arrangement has certain advantages as explained subsequently.

As previously indicated the first collar 6 has internal threads 7 for threadly connecting the coupler to a further body. The body 4 has a circumferential groove 23 (more clearly shown in FIG. 2) to receive the ring 10 while the collar 6 has a groove 24 to receive the ring 10. The body 4 has a further groove 26 to receive wave spring 12; positioned to provide an axially forward force on the shoulder 36 of locking collar 8 to ensure engagement of key 30 into cutouts 32 and 34 of first collar 6.

Figure 3:
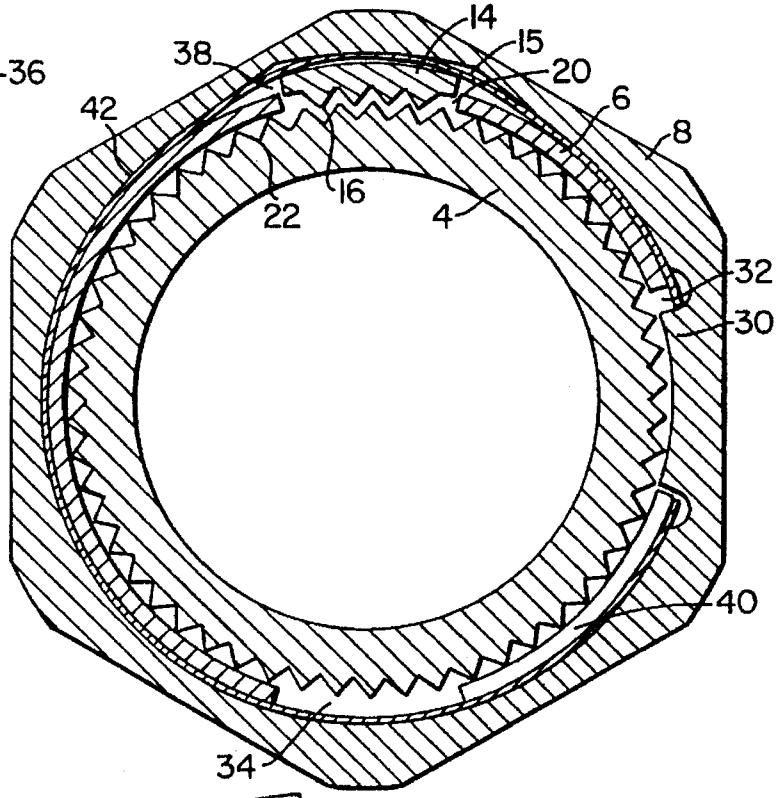
FIG. 3 is a view in cross-section of the coupling in the unlocked position taken along Section 3—3 of FIG. 2.
Figure 2A:
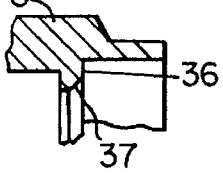
FIG. 2A is a fragmentary section of an assembly detail.
Figure 2:
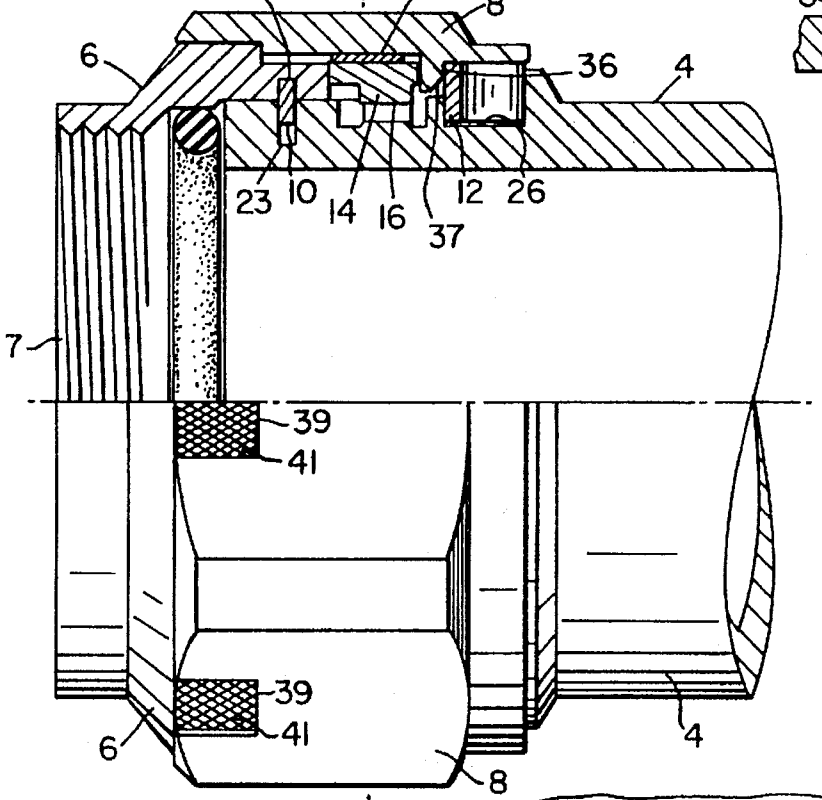
FIG. 2 is a view in the longitudinal section partially showing the coupling in the unlocked position.

Referring now specifically to FIGS. 2, 3 and 4 of the accompanying drawings, the coupler is illustrated in the assembled and locked position. The collar 6 overlies the body 4 and is retained thereon by spring ring 10 seated in the grooves 22 and 23 in the body 4 and collar 6, respectively. This collar to body retaining mechanism is just one typical method of retaining these two items. The ramp 37 on collar 8 permits the collars 6 and 8, after assembly to one another, to be slid over the body 4 with the spring 10 in place, the ramp 37 depressing spring 10. This collar to body retaining mechanism is just one typical method of retaining these two items. The locking collar 8 overlaps the first collar 6, capturing the pawl 14 and the pawl spring 15. The wave spring 12, seated in the groove 26 in body 4 pushes against shoulder 36 on locking collar 8, holding said collar in a forward position against the first collar 6. See FIG. 2A for details of shoulder 36 and ramp 37.

In the unlocked position, a cavity 38 (see FIG. 3) in the locking collar 8 allows the toothed pawl 14, positioned in a cutout 20 in the first collar 6, to ride in and out of engagement with the teeth 22 of body 4. The pawl spring 15 provides a radial inward force on the pawl to provide a racheting effect. The key 30 in the locking collar 8 is positioned, when the coupling is in the unlocked position, in a cutout 32 on the skirt 18 of first collar 6, as shown in detail in FIG. 4 (see also cutouts 32 and 34 in FIG. 1) as indicated previously an opened up flat showing of the skirt 18. The mating surfaces of member 30 and cut-out 34 in the locking collar and first collar, respectively insure a positive engagement between said collars so that when locking collar 8 is pushed back and then rotated the key 30 engages in cut-out 32 and insures that the first collar will also rotate.

When the coupling is installed onto a further body with sufficient torque, the key 30 of locking collar 8 can be disengaged from the cutout 32 on collar 6 with a deliberate rearward motion of the locking collar 8. The force required to move said locking collar rearward can be determined by the compressive force of the wave spring 12 at the time of manufacture. The wave spring represents only one method of providing a forward force, others include, but are not limited to, stamped springs, belville washers, elastomeric springs, and helical springs.

The locking collar 8 has a series of windows 39 cut out in 60 degree increments around its forward edge, allowing the first collar 6 to be seen. Alternating bands of colored strips 41 are painted on the first collar 6, positioned so that when the coupler is unlocked only one color is visible through the windows 39. When unlocked a bright color such as red indicates that the coupler is unlocked. A rotation of the locking collar 8 relative to the first collar 6 by a certain number of degrees hides the color indicating unlocked coupling, and exposes a color indicating the coupling collar 6 is locked. This represents one of many ways in which the visible marker can be applied to the design to indicate the locked and unlocked conditions of the locking coupling.

Figure 6:
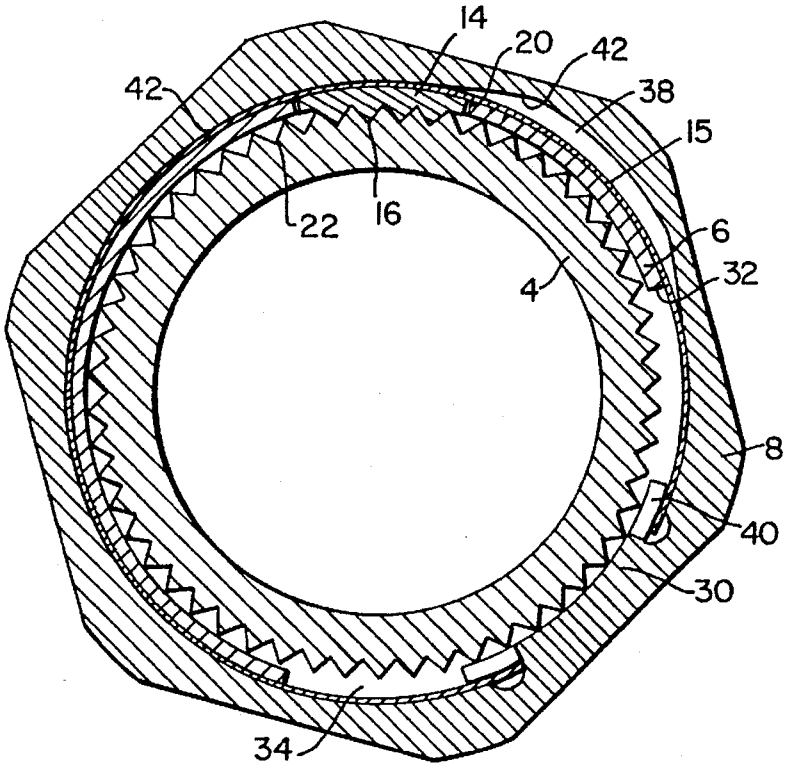
FIG. 6 is a view in cross section of the locking collar and first collar taken along Section lines 6—6 of FIG. 5 in the partially unlocked position.
Figure 5:
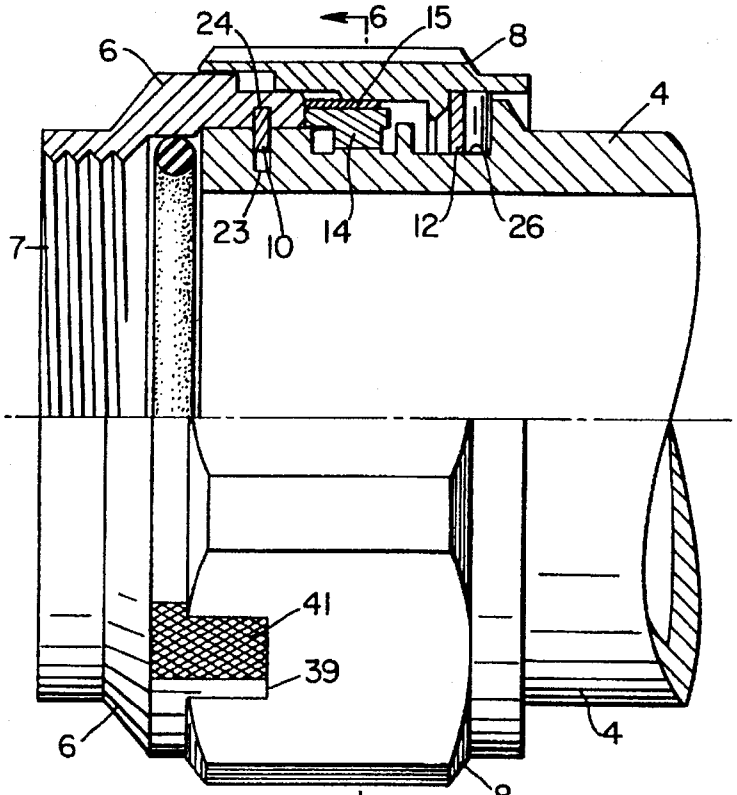
FIG. 5 illustrates in partial cross section the coupling in the partially unlocked position.
Figure 7:
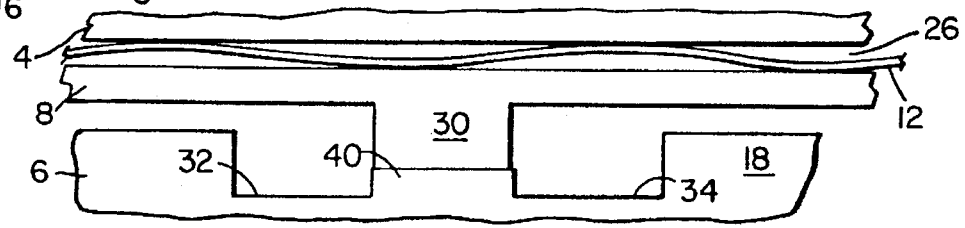
FIG. 7 illustrates diagrammatically the locking collar key and first collar skirt in a partially unlocked position; the key being between the locked and unlocked positions.

Referring now to FIGS. 5, 6 and 7 of the accompanying drawings, the coupler is illustrated in a position in between the locked an unlocked positions. The locking collar 8 is moved rearward, against the compressive force of wave spring 12 in body 4, a distance sufficient for key 30 to clear a shoulder 40 in skirt 18 on first collar 6, so that locking collar 8 is free to rotate independently of first collar 6. The rotation of the locking collar 8 relative to the first collar displaces the alignment of the cavity 38 relative to the pawl 14 positioned in cut-out 20 on first collar 6. The ramped surface 42 of the side cavity 38 drives the teeth 16 on pawl 14 into intimate engagement with teeth 22 on body 4 when the relative rotation of collar 8 relative to collar 6 is as illustrated in FIG. 6.

Figure 9:
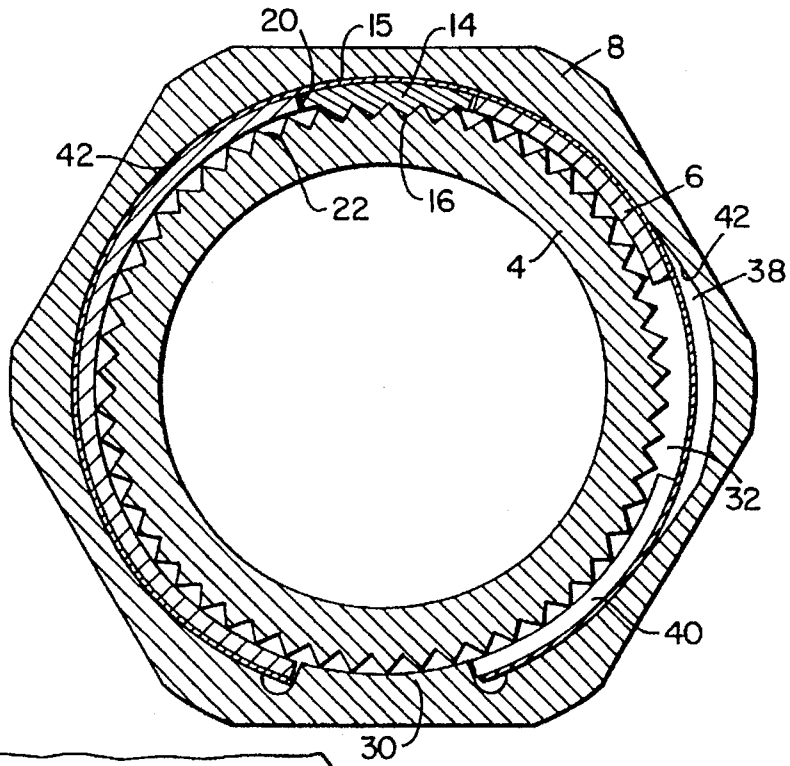
FIG. 9 taken along Section line 9—9 of FIG. 8 illustrates in cross section the collars 6 and 8 in the fully locked position.
Figure 8:
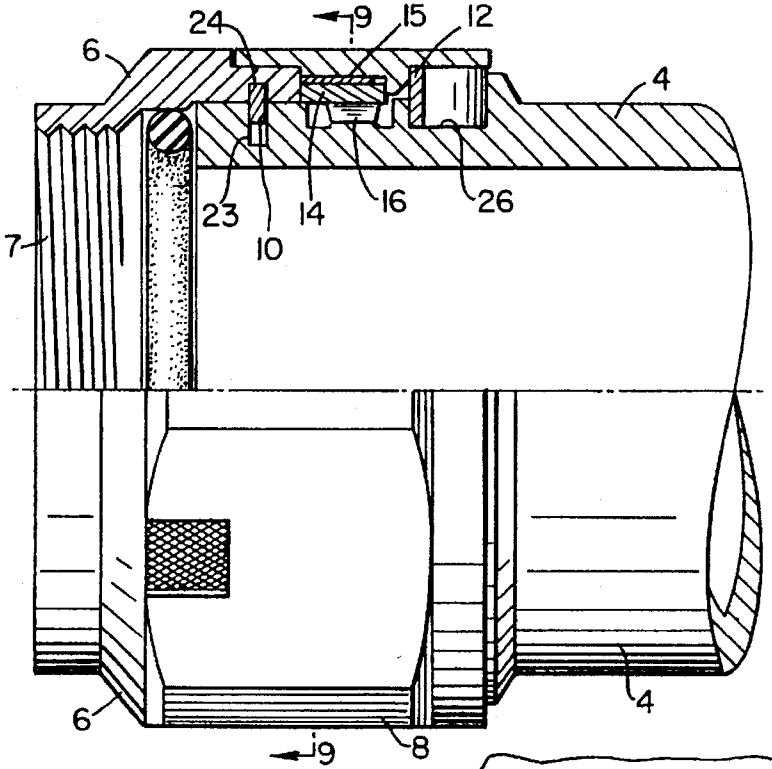
FIG. 8 illustrates the coupling in partial cross section in the locked position.
Figure 10:
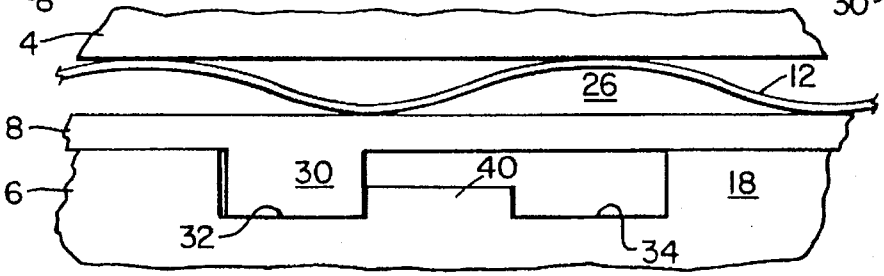
FIG. 10 diagrammatically illustrates the position of the key relative to the collar in the fully locked position.

Referring now to FIGS. 8, 9 and 10 of the accompanying drawings, the coupler is illustrated in the assembled and locked position. The locking collar 8 is rotated to a position where key 30 seats in a cutout 34 in the skirt 18 of first collar 6 thus preventing rotation of said locking collar 8 relative to first collar 6, said locking collar 8 being held in position by the forward force exerted by wave spring 12. The teeth 16 of pawl 14 are fully engaged with the teeth 22 of body 4, thereby preventing rotation of first collar 6 about body 4, said pawl 14 being held in engagement by the inner wall 42 of locking collar 8.

It should be noted that:

1. More than one pawl may be used.
2. The holding strength can be varied by the number of teeth on a pawl.
3. A small amount of play between the pawl 14 and its cutout 20 allows the pawl to adjust to engage the teeth even when they are not perfectly aligned with the teeth on the body.
4. The components can be made of metals or plastics.
5. The teeth in the body 4 can be replaced with an elastomeric material, such as polyurethane, attached to the body. This latter arrangement allows the teeth in the pawl to dig into the elastomeric material, and prevent rotation of the first collar; the advantages of this being ease of manufacture, and elimination of teeth alignment concerns.
6. The outer surfaces of the first and second collars can be round with knurls, or hexed.
7. Sometimes the teeth on the pawl and body do not align despite the gap in the cutout. When this happens the locking mechanism will not easily engage, at least not by hand. With this design, the installation tool such as a strap wrench can be used to force the pawl into place. This is an advantage over prior locking coupling systems because alignment could not be achieved by force if they did not line up initially.
8. The toothed pawl can be replaced by a small ball bearing which rides in a hole in the first collar skirt, and seats in the teeth in the body. This approach is a low cost alternative to the pawl.

Figures 11, 12, 13:
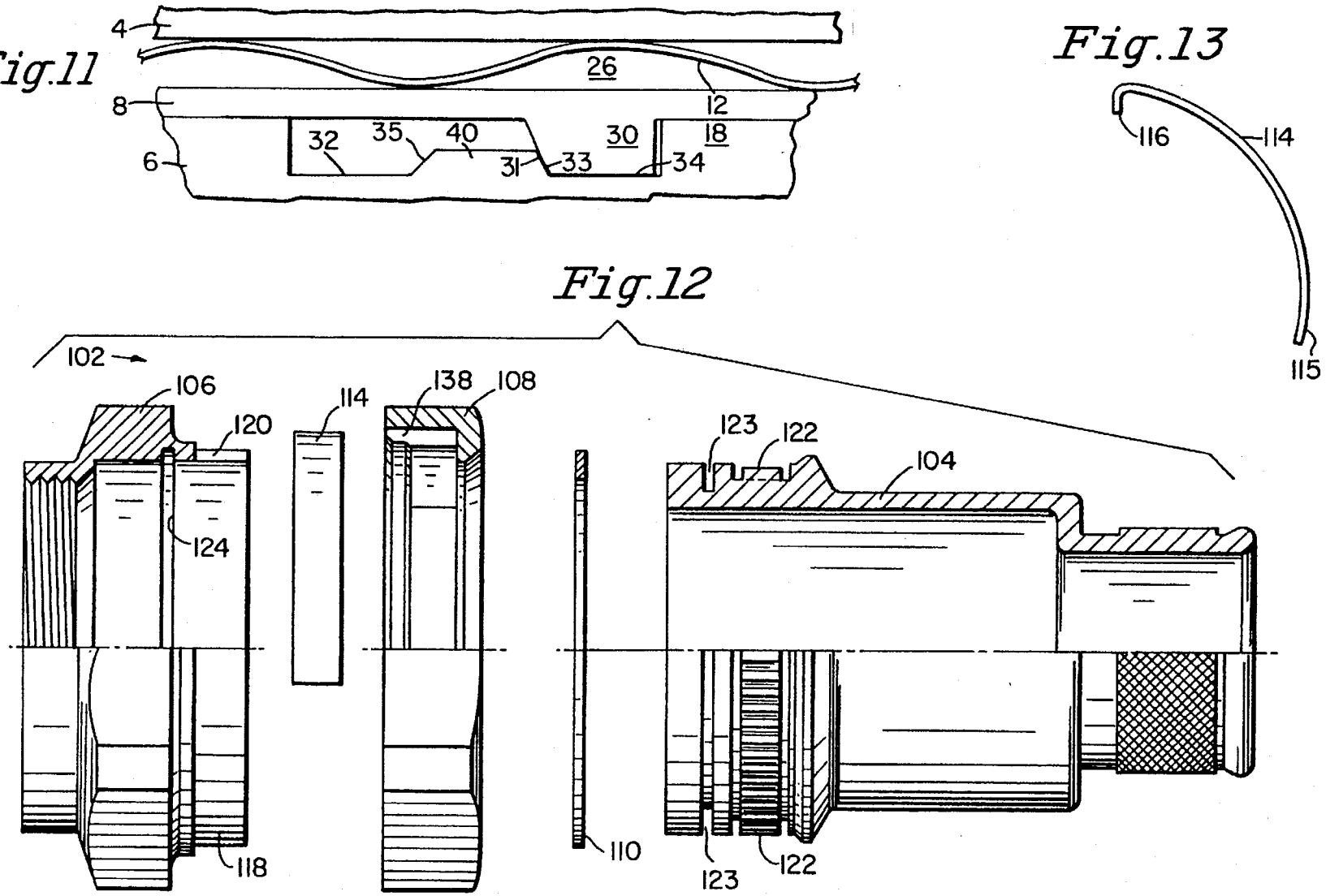
FIG. 11 illustrates a modification of the interrelationship of the key and skirt of the first collar in the unlocked position.
FIG. 12 illustrates an exploded view of a second embodiment of the present invention.
FIG. 13 illustrates the pawl of the second embodiment of the invention.

The locking and unlocking features of the current invention can be modified so that the locking mechanism automatically engages at a predetermined torque limit. Referring now to FIG. 11 of the attached drawings, a modified embodiment of the current invention is depicted, showing the skirt 18 of first collar 6, element 30 of locking collar 8 and a partial view of body 4, all shown as a flat projection, as if unwrapped and laid on a flat surface. The embodiment depicted in FIG. 11 is achieved with only subtle changes to angles of the key 30 of locking collar 8, and the cutouts 32 and 34 of first collar 6 of FIGS. 1 to 10. The coupler is shown in the unlocked position.

The mating surfaces 31 on key 30 and 33 of cutout 32 are angled to form a ramped wedge. When an installation torque is applied to locking collar 8, the torque is transmitted to the first collar 6 by interaction of the key surface 31 against surface 33 of cutout 32. The wave spring 12 provides a downward force as illustrated in FIG. 11 to prevent slippage of the wedge surfaces 31 and 33. When first collar 6 is threaded onto a further body, the threads begin to tighten resisting further motion. Continued application of torque to locking collar 8 causes the wedging effect of surface 31 to overcome the force of the wave spring 12 and the surface begins to slide backward and to the left along the wedge of surface 33 until said surfaces are no longer in contact and the locking collar 8 can continue to rotate into a locked position with key 30 seated in cutout 34 as described in the previous embodiment.

The torque required for surface 31 to fully slide past surface 33 can be determined at the time of manufacture by selection of the wedge angles, and the force of wave spring 12. Using the same wedge surface principle in the reverse direction, the locking mechanism can be designed to automatically unlock.

Again referring to FIG. 11, cut-out 34 has an angled wedge surface 35. In the locked position key 30 seats in cutout 34. When a removal torque is applied to locking ring 8, the right side surface of key 30 slides backwards and to the right along wedge surface 35 until key 30 is clear of cutout 34 and free to rotate into an unlocked position. Continued application of removal torque to locking coupling 8 causes the right surface of key 30 to engage the right surface of cutout 32, and apply the removal torque to collar 6. The torque required to automatically unlock the coupling can be set at the time of manufacture. This is a significant feature because it prevents a person from damaging the locking mechanism by attempting to remove the coupling in the locked position. A person totally unfamiliar with the design can unscrew the coupling with no knowledge of the locking coupling mechanism. This feature improves on a substantial limitation of existing designs.

A fully automatic version of the locking coupling includes both the torque limiting/auto-locking feature, and the auto unlocking feature.

Referring to FIGS. 12 and 13 a further embodiment of locking coupling is illustrated. A locking coupling 102 is composed of a first collar 106, a toothed spring pawl 114, a locking collar 108, a retaining ring 110, and a body 104. The toothed spring pawl 114 includes a tooth or generally right angle member 116, and a tail 115 as shown in FIG. 13.

A first collar 106 has a slot 120 into which tooth 116 of spring pawl 114 is placed. The pawl is enclosed on the first collar 106 on the lower side of the collar and a cavity 138 in locking collar 108 on the upper side. The first collar 106, pawl 114, and lock ring 108 are positioned over a body 104 so that the tooth 116 overlaps a band of axial circumferential teeth 122. The first collar 106 is held to body 104 with the retaining ring 110 located in grooves 124 and 123 in the first collar 106 and body 104 receptively. Locking collar 108 is positioned between the first collar 106 to the front, and a shoulder 126 on body 104 to the rear.

Figure 15:
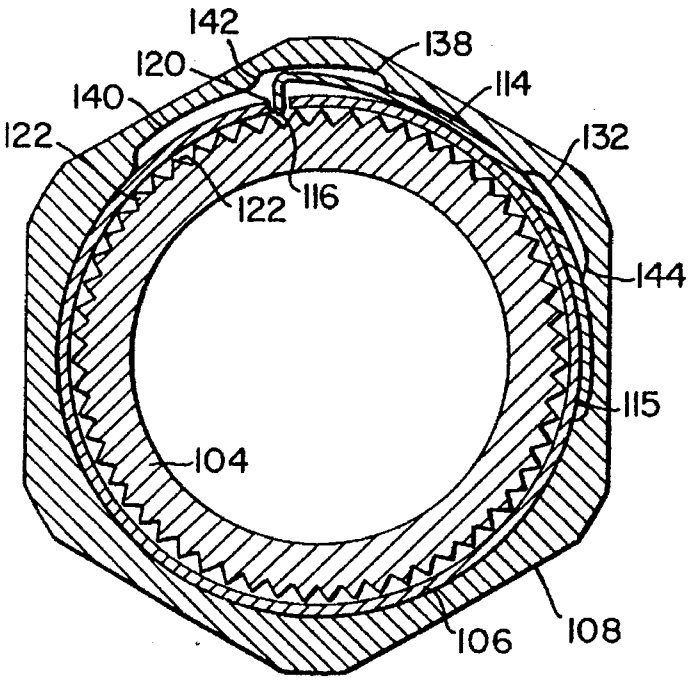
FIG. 15 taken along Section line 15—15 of FIG. 14, illustrates the relative position of the locking and first collars in the unlocked position.
Figure 14:
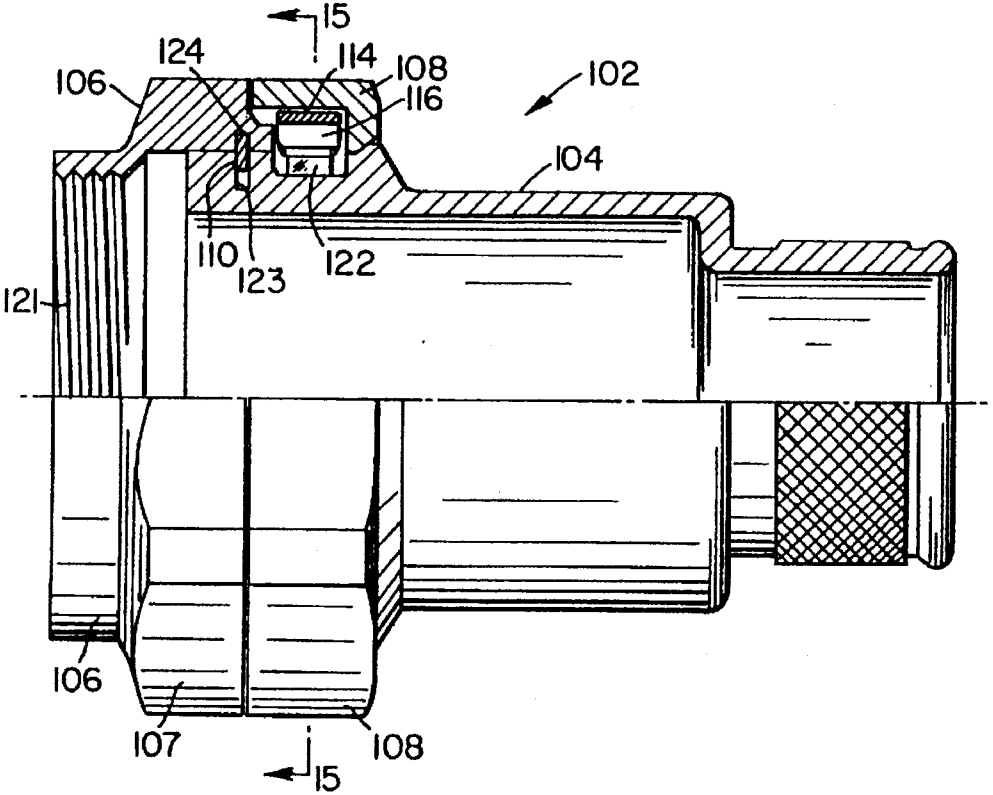
FIG. 14 illustrates in partial cross section the second embodiment of the invention in the unlocked position.

Referring now to FIGS. 14 and 15, the coupler 102 is shown in the unlocked position. The locking collar 108 is positioned so that a cavity 138 is located over the tooth 116 on spring pawl 114 so as to allow said tooth to ride in and out of engagement with the teeth 122 on body 104. In this unlocked position the coupler can be installed on a further body by applying torque to the threaded first collar 106 in the hex region 107.

Figure 17:
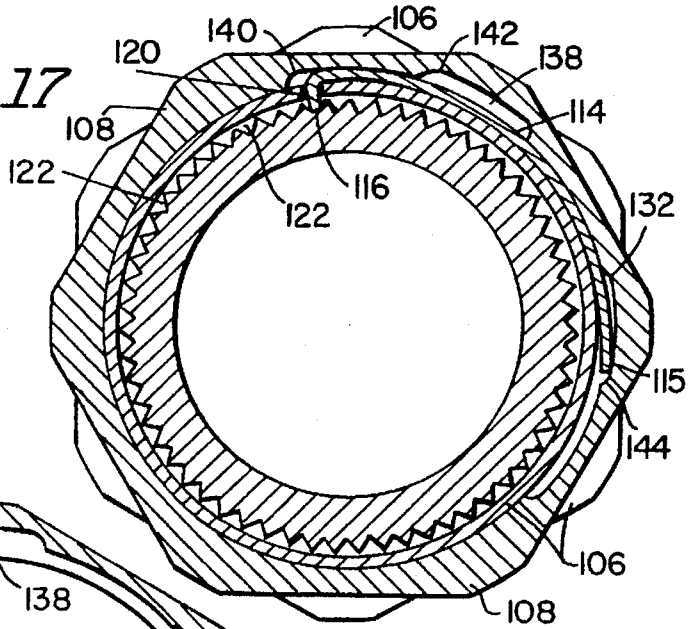
FIG. 17 taken along Section line 17—17 of FIG. 16 illustrates the collars in the locked position.
Figure 18:
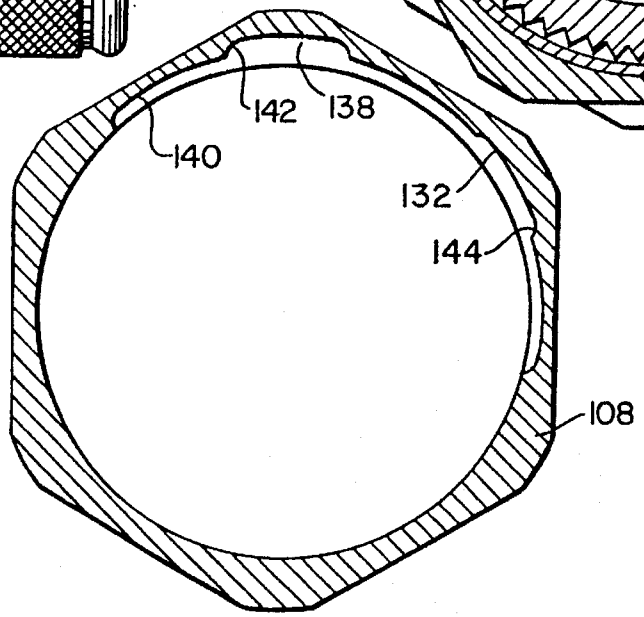
FIG. 18 illustrates a front view of the locking collar in section.
Figure 16:
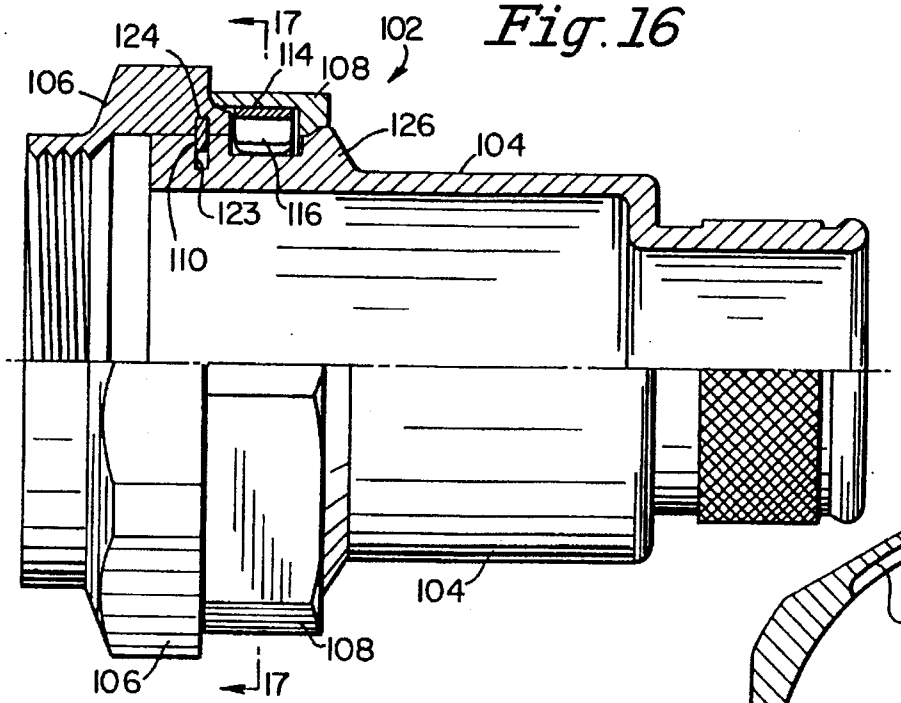
FIG. 16 illustrates in partial cross section the coupling of the second embodiment in the fully locked position.

Referring now to FIGS. 16 and 17, the coupler 102 is shown in the locked position. The locking collar 108 is rotated a number of degrees relative to the first collar 106 so that tooth 116 of spring pawl 114 is forced into engagement with teeth 122 of body 104. A ramped surface 142 on the left side of cavity 138 serves to drive the tooth 116 into engagement as the locking collar 108 is rotated to a point were the tooth 116 is held securely in the teeth 122 by a surface 140 internal to locking collar 108. Thus the first collar 106 is prevented from rotation about the body 104 by the tooth 116 being passed through a slot 120 in first collar and being held in engagement with teeth 122 on body 104 by a surface 140 on locking collar 108.

The locking collar 108 is held in the locked position by the tail 115 of spring pawl 114 which snaps radially outward into a cavity 132 in locking collar 108. Tail 115 serves as a detent to hold the locking collar 108 in a locked position with the tail 115 engaged against a ramped surface 144 on the left side cavity 132. The locking collar remains in the locked position until a torque is applied creating a sufficient inward force to drive tail 115 radially inward, and thus allow the locking collar 108 to rotate to an unlocked position. The torque required to unlock the coupling can be determined at the time of manufacture by the selection of force on tail 115 of spring pawl 114, and the angle of ramped surface 144 on cavity 132.

The locked position is indicated by a misalignment of the hexes on the first collar 106, and the locking collar 108 (see FIG. 17), as one example of several methods.

Once given the above disclosure, many other features, modifications and improvements will become apparent to the skilled artisan. Such features, modifications and improvements are, therefore, considered to be a part of this invention, the scope of which is to be determined by the following claims.

What is claimed is:

1. A locking coupling comprising a body having a plurality of radially outwardly protruding teeth;

a first collar rotatably mounted on said body and having an opening at one end;

a pawl having at least one inwardly protruding tooth suitable for engagement with said teeth on said body, said tooth extending through said opening in said first collar in alignment with said teeth;

a locking collar mounted on said first collar for movement between various positions;

said locking collar in one of said positions causing at least one tooth of said pawl to engage the teeth on said body whereby to resist movement of said first collar relative to said body.

2. A locking coupling according to claim 1 further comprising resilient means for retaining said at least one tooth in engagement with said teeth.

3. A locking coupling according to claim 2 wherein said resilient means and said locking collar are interrelated to permit rotation of said first collar relative to said body upon application of a predetermined force to decouple said first collar from a further body.

4. A locking coupling comprising a hollow, cylindrical coupling collar having adjacent one end a structure for coupling the collar to a further entity, said coupling collar having a circular skirt at its other end with at least three generally and circumferentially spaced rectangular recesses in the end of the skirt, a locking collar coaxial and rotatable about said coupling collar and having a key dimensioned to fit into two of said recesses in said coupling collar, a cylindrical body having formed on an outer surface thereof a plurality of radial, axially extending teeth, said collars disposed about and coaxial with said cylindrical body such that a third one of said recesses is disposed in radial alignment with said teeth, a toothed pawl disposed in said third recess over said teeth on said cylindrical body, said locking collar having an internal circumferential rim disposed about and in circumferential alignment extending with said pawl and having a radial recess therein, said recess upon being located over said pawl permitting the pawl to rise and fall relative to said teeth on said cylindrical body to provide a ratcheting effect upon rotation of said collars about said cylindrical body, said rim having a non-recessed region, said pawl forced into locking engagement with said non-recessed region of said rim being disposed over said pawl whereby to prevent rotation of said collars about said cylindrical body.

5. A locking coupling according to claim 4 further comprising spring means for holding said key in engagement with said recesses.

6. A locking coupling comprising a coupling collar having at one end a structure for coupling to a further body and adjacent a second end at least one recess, a locking collar coaxial with and rotatable about said coupling collar, a pawl disposed between said collars, a cylindrical body having a circumferential ring of radial axially extending teeth, said collars disposed about said cylindrical body such that said one recess in said coupling collar is aligned with said teeth, said pawl having at least one tooth extending through said at least one recess in alignment with said teeth, said locking collar having an internal configuration such that in one position relative to said coupling, said at least one tooth is in firm contact with said teeth and in a second position relative to said coupling collar said at least one tooth may move out of firm engagement with said teeth.

7. A locking coupling according to claim 6 wherein said pawl further comprises an arcuate spring with a generally right angled finger defining said at least one tooth.

8. A locking coupling according to claim 6 wherein said one end of said coupling collar having an exterior configuration of numerous circumferentially flat faces, said locking collar having an exterior of numerous circumferentially arranged flat faces of the same number, size and shape as the flat faces of said coupling collar, said flat faces of said collars being disposed adjacent to and coaxial with one another, said flat faces being aligned when the pawl is in firm engagement with said teeth.

9. A locking coupling according to claim 6 wherein said pawl has a plurality of arcuately arranged and axially extending teeth, and said one recess is arcuate to receive said pawl.

10. A locking coupling comprising a cylindrical body, a hollow, cylindrical coupling collar rotatably mounted on said body, and having adjacent one end a structure for coupling the collar to a further body, a locking collar coaxial about said coupling and possessing a member to transmit a torque to said coupling, a locking means to prevent said coupling collar from rotation about said body, an engagement means to activate said locking means, a disengagement means to deactivate said locking means, said disengagement means being initiated by an applied torque to said locking collar, said engagement means and said disengagement means effecting engagement and disengagement, respectively, by applying torque thereto in opposite directions.

* * * * *